US009274541B1

(12) United States Patent
Ford et al.

(10) Patent No.: US 9,274,541 B1
(45) Date of Patent: Mar. 1, 2016

(54) ADJUSTABLE MOTOR VEHICLE PEDAL

(71) Applicant: Lokar, Inc., Knoxville, TN (US)

(72) Inventors: Kevin Ford, Knoxville, TN (US); Scott Thiel, Sherwood, OR (US)

(73) Assignee: Lokar, Inc., Knoxville, TN (US)

( * ) Notice: Subject to any disclaimer, the term of this patent is extended or adjusted under 35 U.S.C. 154(b) by 0 days.

(21) Appl. No.: 14/515,229

(22) Filed: Oct. 15, 2014

(51) Int. Cl.
*G05G 1/40* (2008.04)
*G05G 1/38* (2008.04)
*G05G 5/05* (2006.01)

(52) U.S. Cl.
CPC .. *G05G 1/40* (2013.01); *G05G 1/38* (2013.01); *G05G 5/05* (2013.01)

(58) Field of Classification Search
CPC ..... G05G 1/38; G05G 1/40; G05G 1/44; G05G 1/46; G05G 5/06; B60K 2026/026; B60T 7/06
USPC ..... 74/514
See application file for complete search history.

(56) References Cited

U.S. PATENT DOCUMENTS

| | | | | |
|---|---|---|---|---|
| 1,556,921 | A * | 10/1925 | Emerson | 74/562 |
| 8,539,858 | B2 * | 9/2013 | Saito et al. | 74/513 |
| 2005/0247158 | A1 * | 11/2005 | Willemsen et al. | 74/513 |
| 2006/0117902 | A1 * | 6/2006 | Martin et al. | 74/512 |
| 2007/0095163 | A1 * | 5/2007 | Meguro | 74/513 |
| 2011/0308350 | A1 * | 12/2011 | Crites et al. | 74/560 |

* cited by examiner

*Primary Examiner* — Vicky Johnson
(74) *Attorney, Agent, or Firm* — Pitts & Lake, P.C.

(57) ABSTRACT

An adjustable vehicle control pedal comprises a first arm having a first end rotatable along a plane between first and second positions. The first end defines a first through opening extending nonparallel to the plane. A second arm has a first end defining a second through opening extending nonparallel to a long dimension of the second arm. The second arm is repositionable in relation to the first arm among a plurality of positions in which the first and second through openings are in substantially coaxial adjacent registration with one another. An insert is receivable through the first and second through openings in each of the plurality of positions to lock the second arm against rotation in relation to the first arm along the plane. A position sensor is responsive to movement of the first arm between the first and second positions.

12 Claims, 5 Drawing Sheets

ADJUSTABLE MOTOR VEHICLE PEDAL

CROSS-REFERENCE TO RELATED APPLICATIONS

Not Applicable

STATEMENT REGARDING FEDERALLY-SPONSORED RESEARCH OR DEVELOPMENT

Not Applicable

BACKGROUND OF THE INVENTION

1. Field of Invention

The invention relates to motor vehicle parts and accessories, and more particularly, to control pedals useful in controlling operation of a throttle, brake, or clutch of a motor vehicle.

2. Description of the Related Art

In motor vehicles, foot-controlled pedals are employed as continuously variable controllers for operation of the throttle, brake, and/or clutch of the motor vehicle. A motor vehicle pedal typically consists of a lever arm having a first end rotatably secured to a controller comprising one or more suitable mechanical linkages, gears, cables, or other such devices for translating rotational movement of the lever arm into operative engagement of the associated throttle, brake, or clutch. An opposite second end of the lever arm typically extends to a location inside the cab of the motor vehicle, near the front end of the driver's side floorboard, where it may be readily accessed by a driver of the motor vehicle. In most designs of motor vehicle pedals, a foot pad is disposed at the second end of the lever arm to provide a bearing surface for the driver's foot, such that downward and/or forward force from the driver's foot operates to rotate the lever arm from an at-rest position toward the floor or front wall of the cab of the motor vehicle, thereby providing the rotational movement for operation of the associated control for the throttle, brake, or clutch. Often, the lever arm is spring-biased toward the at-rest position, such that release of the foot pad by the driver allows the lever arm to return to the at-rest position, thereby disengaging the associated control for the throttle, brake, or clutch.

Motor vehicle pedals typically include mounting means for securing the pedal in position in a motor vehicle. Such mounting means are typically provided on or about the pedal controller, to which the lever arm is rotatably secured. Furthermore, most motor vehicles include specific mounting locations along the interior of the motor vehicle to which a motor vehicle pedal must be secured in a specific orientation within the motor vehicle.

In order for a pedal to be capable of exhibiting sufficient range of rotational movement for operation of an associated throttle, brake, or clutch control, the pedal must be mounted such that, when the pedal is in the at-rest position, the second end of the lever arm extends outwardly from the front wall of the motor vehicle's cab and terminates upwardly from the floor of the motor vehicle such that sufficient space is provided to accommodate rotation of the lever arm. However, if the second end of the pedal extends outwardly too far from the front wall of the cab, or if the foot pad is positioned too high or too low in relation to the floor, operation of the pedal may be difficult or uncomfortable. Thus, for a given motor vehicle, the overall permissible shape, length, configuration, and angle of extension of a lever arm of a motor vehicle pedal in relation to the pedal controller is often constrained by the dimensional limitations of the interior of the motor vehicle, as well as the specific location provided for mounting the pedal controller within the motor vehicle.

In providing aftermarket or replacement motor vehicle pedals, difficulty arises in that, for the reasons discussed above, different configurations of motor vehicle interiors call for motor vehicle pedals having different configurations of overall shape, length, and angle of extension of the lever arm of the pedal in relation to the pedal controller. Traditionally, this difficulty has been overcome by providing a variety of different designs of motor vehicle pedals incorporating a variety of different shapes, lengths, and/or angles of extension of the lever arm of the pedal in relation to the pedal controller. However, when selecting among such different pedal designs, additional difficulty arises in ensuring proper selection of a motor vehicle pedal design for a given motor vehicle, which will enable proper mounting of the pedal within the vehicle and a proper "fit" of the lever arm and foot pad at a desirable location within the motor vehicle interior.

In light of the above, a motor vehicle pedal which may be adjusted to accommodate a variety of motor vehicle interiors and a variety of mounting positions within a motor vehicle interior is desired.

BRIEF SUMMARY OF THE INVENTION

Described herein is an adjustable vehicle control pedal that allows for selective repositioning of a foot pad portion of the pedal in relation to a controller portion of the pedal, thereby making the pedal adjustable to a variety of motor vehicle interiors and a variety of mounting positions within a motor vehicle interior.

In some of its many embodiments, the present general inventive concept provides a pedal having a sensor module with a first lever arm mounted for rotatable movement between a first position and a second position. The first lever arm is in operative communication with one or more position sensors received within the module which are configured to respond to movement of the first lever arm between the first and second positions, and to produce an output in response to such movement which may be used to control a throttle of a motor vehicle to allow variable control of the throttle. The pedal also includes a second lever arm that carries a foot pad and is securable to the first lever arm at an end of the first lever arm. An adjustable coupling is provided between the first and second lever arms such that the angle of extension of the second lever arm in relation to the first lever arm is adjustable. The second arm is repositionable in relation to the first arm among a plurality of positions in which the first and second through openings are in substantially coaxial adjacent registration with one another, which allows the pedal to exhibit sufficient range of rotational movement for operation of an associated throttle, brake, or clutch control.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Reference will now be made to example embodiments of the present general inventive concept, some of which are illustrated in the accompanying drawings and illustrations. The example embodiments are described herein, and with reference to the figures, in order to explain the present general inventive concept and to assist the reader in gaining a comprehensive understanding of the methods, apparatuses, and/or systems described herein. Accordingly, various changes, modifications, and equivalents of the methods, apparatuses, and/or systems described herein will be understood and suggested to those of ordinary skill in the art. For example, as discussed above, a motor vehicle pedal may be provided to control operation of a throttle, brake, and/or clutch of a motor vehicle. For the sake of simplicity herein, the term "throttle" may be used to refer collectively to any of a variety of motor vehicle controls commonly associated with a pedal, including but not limited to a throttle, brake, and/or clutch of a motor vehicle.

Figure 1:
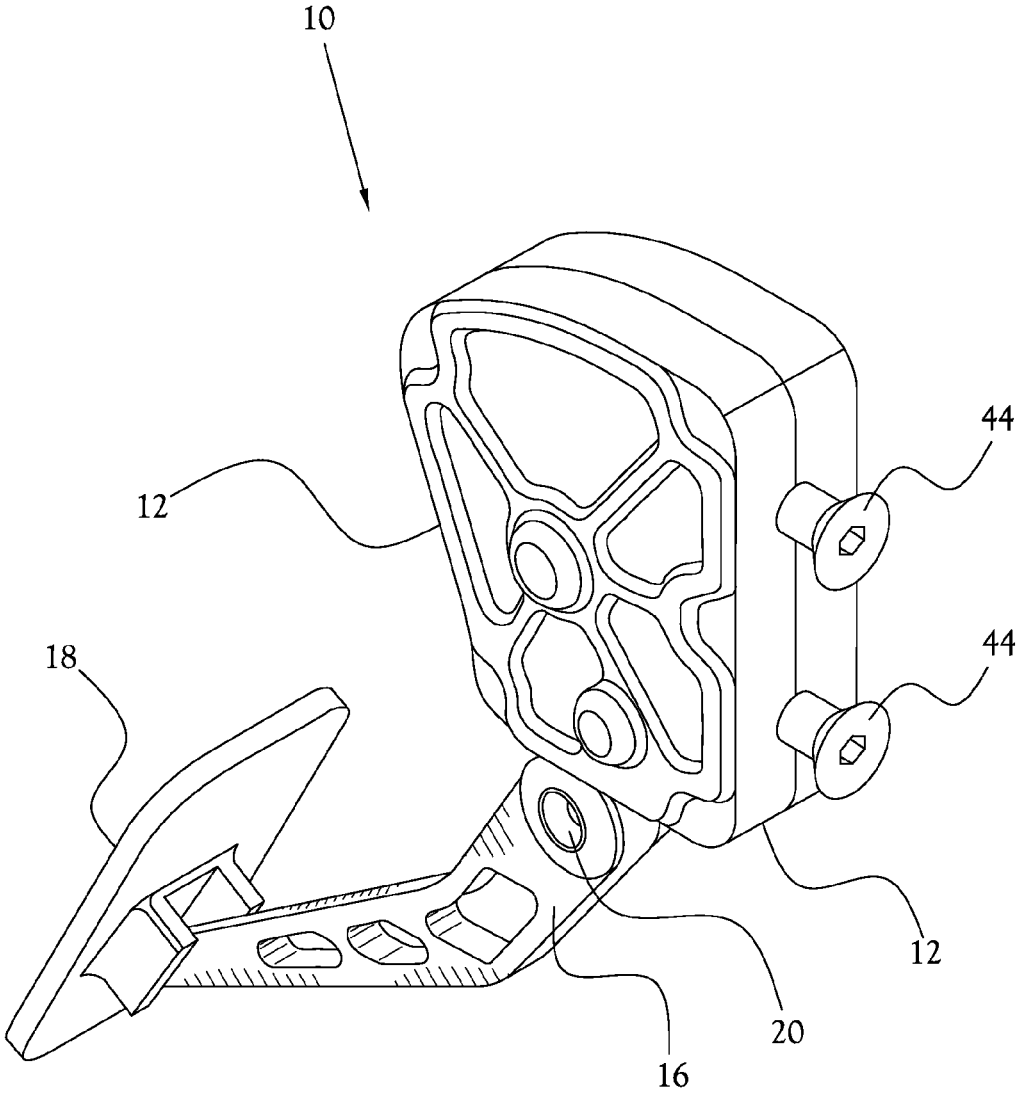
FIG. 1 is a perspective view of one example embodiment of the pedal constructed in accordance with several features of the present general inventive concept.
Figure 2:
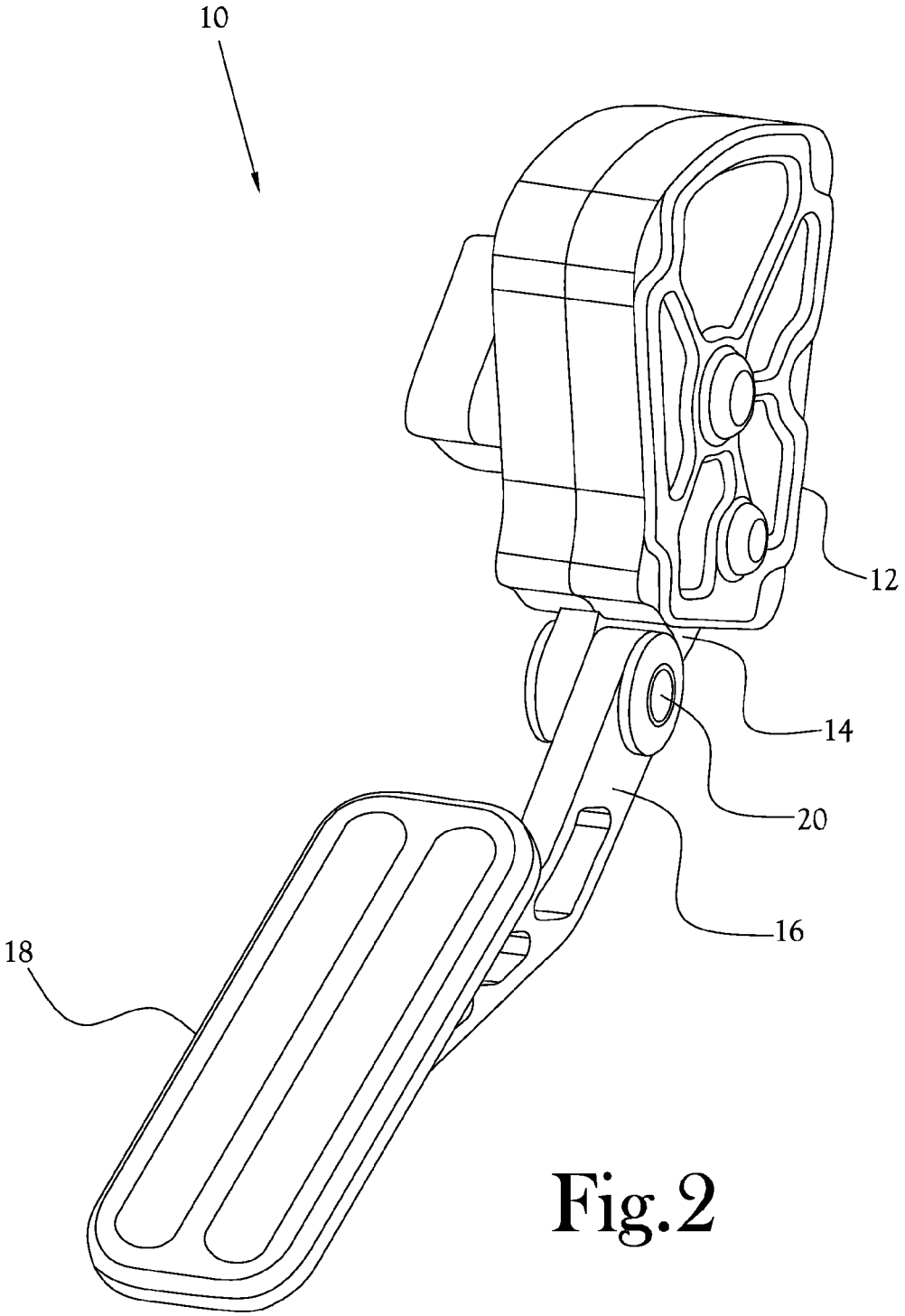
FIG. 2 is another perspective view of one example embodiment of the pedal constructed in accordance with several features of the present general inventive concept.

According to several features of the present general inventive concept, an adjustable motor vehicle pedal is provided which allows for selective repositioning of a foot pad portion of the pedal in relation to a controller portion of the pedal, for example in order to allow the adjustable motor vehicle pedal to be fitted to a variety of automobile interiors. One embodiment of an adjustable motor vehicle pedal, or "pedal," constructed in accordance with several features of the present general inventive concept is illustrated generally at 10 in the figures. Referring to FIG. 1, in one embodiment, the pedal 10 includes generally a sensor module 12 having a first lever arm 14 mounted for rotatable movement between a first position (FIG. 4) and a second position (FIG. 5). The first lever arm 14 is in operative communication with one or more position sensors received within the module 12 which are configured to respond to movement of the first lever arm 14 between the first and second positions, and to produce an output in response to such movement which may be used to control a throttle of a motor vehicle to allow variable control of the throttle. A second lever arm 16, which carries a foot pad 18, is securable to the first lever arm 14 at an end of the first lever arm 14 opposite the module 12, such that the second lever arm 16 may extend generally away from the first lever arm 14 opposite the module 12 to provide additional leverage for rotation of the first lever arm 14 between the first and second positions. As will be further discussed herein, according to several features of the present general inventive concept, an adjustable coupling 20 is provided between the first and second lever arms 14, 16 such that the angle of extension of the second lever arm 16 in relation to the first lever arm 14 is adjustable. Thus, the configuration of the foot pad 18 in relation to the controller 12 may be adjusted among a plurality of positions.

Figure 4:
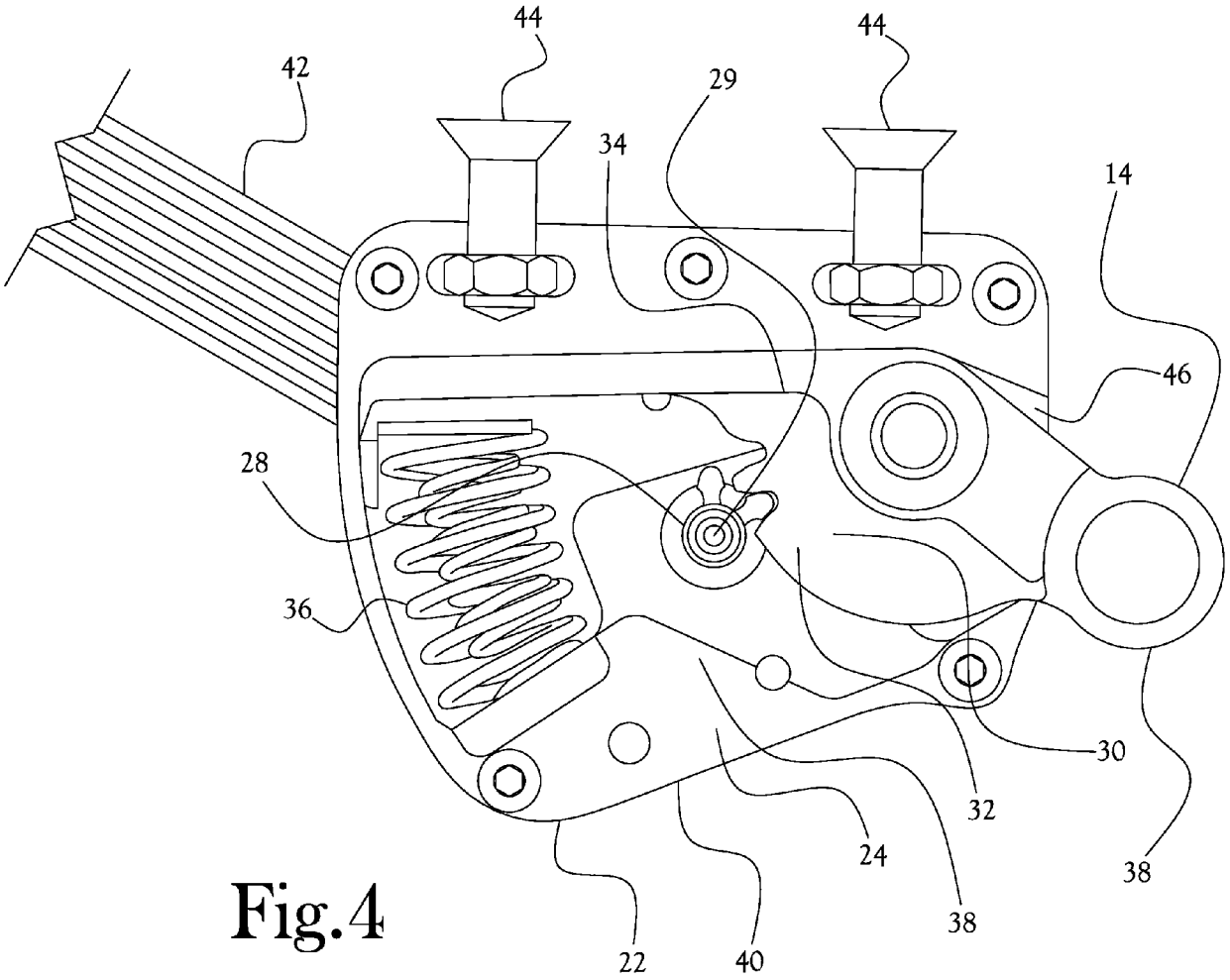
FIG. 4 is another exploded view of FIG. 2 showing an interior view of the sensor modal when the first level arm mounted for rotatable movement in the first position.
Figure 5:
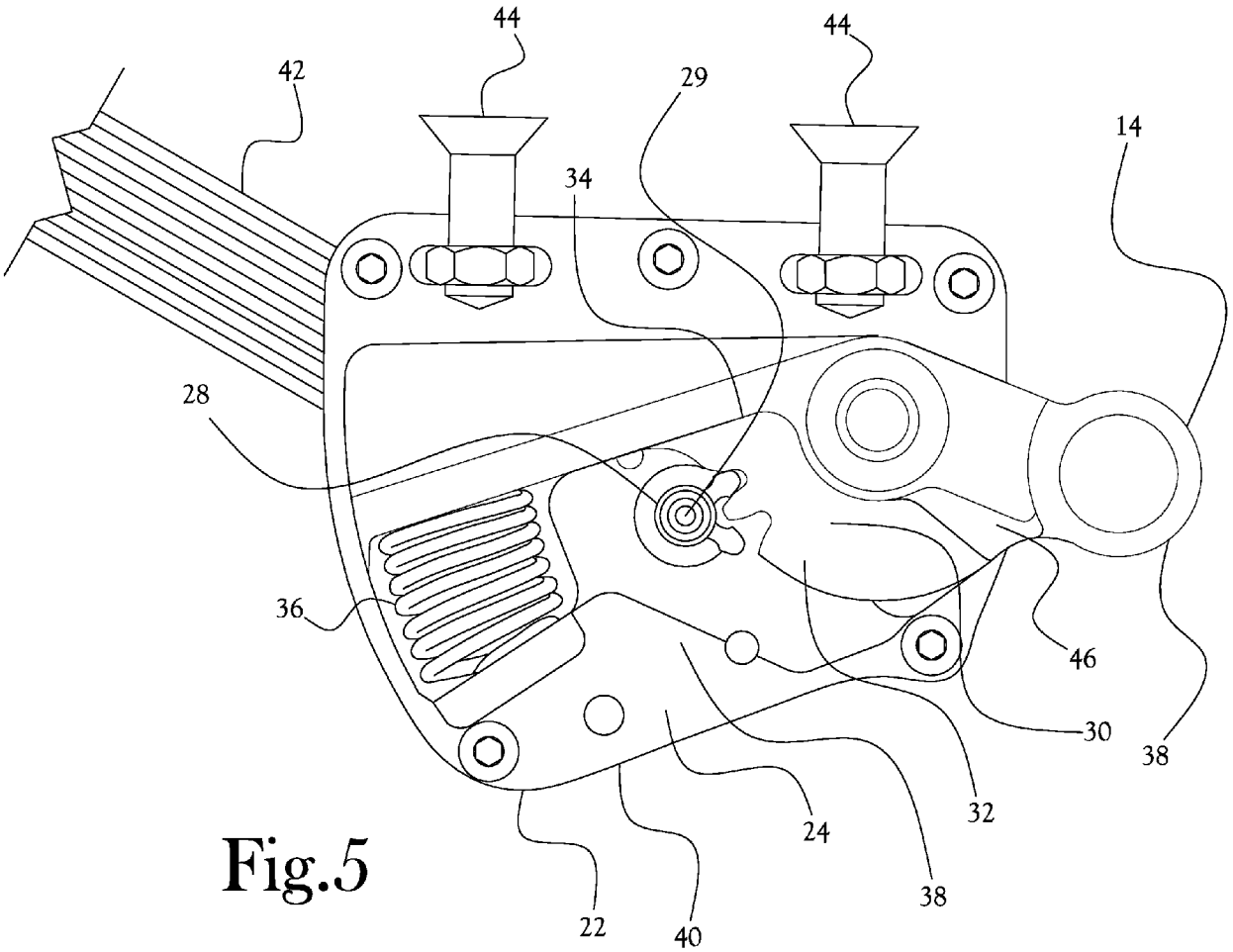
FIG. 5 is an exploded view of FIG. 2 showing an internal view of the sensor modal when the first level arm mounted for rotatable movement in the second position.

Referring to FIGS. 4-5, in several embodiments, the module 12 is a so-called "drive-by-wire" pedal module of the type known to one of skill in the art and commonly associated with electronic throttle controls. More specifically, in the illustrated embodiment, the module 12 includes a housing 22 defining an interior 24 which contains at least one variable position sensor 26 therein. In some embodiments, the variable position sensor 26 may include a gear 28 which is linked to an electronic variable control 29, such as for example a potentiometer, rheostat, or other such variable resistor, such that rotation of the gear 28 results in actuation of the variable control. The variable control is capable of being placed in electronic communication with an electronic throttle control via suitable devices known to one of ordinary skill in the art, such as for example the illustrated cables 42.

In several embodiments, suitable fasteners 44 are provided to allow the housing 22 to be mounted to an appropriate location of a vehicle interior, such as for example proximate the driver's side floorboard and front wall of an automobile. In the illustrated embodiment, the housing 22 is configured to be mounted below the dashboard of an automobile, such that the remainder of the pedal 10 extends in a "hanging" configuration beneath and rearward of the housing 22. However, it will be recognized that various other types of fasteners may be provided in various configurations to allow mounting of the housing 22 in a hanging configuration, an upwardly-projecting configuration, or other configurations of the type know to one of skill in the art, and that such other fasteners and configurations may be employed without departing from the spirit and scope of the present general inventive concept.

In the illustrated embodiment, the first lever arm 14 is rotatably mounted, proximate a central portion 30 thereof, within the housing 22 and extends externally and generally downwardly thereof. A rack 32 is defined along the first lever arm central portion 30 and is in mechanical engagement with the gear 28, such that rotation of the first lever arm 14 between the first and second positions results in rotation of the gear 28, and thus, actuation of the variable control. In several embodiments, the first lever arm 14 has a first end 34 which extends into the housing interior 24. At least one spring 36 is provided in operable engagement with the first lever arm 14 in order to bias the first lever arm 14 toward the first position. In the illustrated embodiment, a pair of substantially coaxial compression springs 36 are provided extending between the first lever arm first end 34 and a bearing surface 38 provided along a wall 40 of the housing 22 opposite the first lever arm first end 34 when the first lever arm 14 is in the first position. As the first lever arm 14 is moved toward the second position, the first end 34 is brought toward the bearing surface 38, thereby compressing the springs 36. Thus, when the first lever arm 14 is released, compression from the springs 36 urges the first lever arm 14 toward the first position. Those skilled in the art will recognize other devices and configurations which are suitable for biasing the first lever arm 14 toward the first position, and such other devices and configurations may be used without departing from the spirit and scope of the present general inventive concept.

As noted above, a second end 38 of the first lever arm 14 extends through an opening 46 in the housing 22 to a location exterior of the housing 22. The opening 46 is sized to allow movement of the second end 38 of the first lever arm 14 between the first and second positions. Thus, in the present embodiment, force may be applied to the second end 38 from exterior of the housing 22 to move the first lever arm 14 from the first position toward the second position, and such force may be released to allow the first lever arm 14 to return to the first position.

As discussed above, a second lever arm 16 is provided having a first end 48 which is securable to the second end 38 of the first lever arm 14, and a second end 50 which is configured to extend generally outwardly from the first lever arm 14 opposite the module 12. The second end 50 of the second lever arm 16 is linked to a foot pad 18 defining a user contact surface 52 which faces generally outwardly from the second lever arm 16, and which is configured to allow a user to apply pressure to the foot pad 18 via the user's foot or other means, thereby applying rotational force to the second end 50 of the second lever arm 16 to rotate the first and second lever arms 14, 16 toward the second position. Thus, the second lever arm 16 serves to provide additional leverage for rotation of the first lever arm 14 between the first and second positions. In the illustrated embodiment, the foot pad 18 is secured to the second lever arm 16 via a hinge connection, such that the foot pad 18 is capable of at least slight rotation about the second end 50 of the second lever arm 16 in a plane generally parallel to the plane of rotation of the first and second lever arms 14, 16 between the first and second positions. Thus, the foot pad 18 may rotate slightly upon contact with a foot of a user to allow the user's foot to establish more secure, uniform contact with the user contact surface 52. In another embodiment, the foot pad 18 is fixed to the second end 50 of the second lever arm 16.

In the illustrated embodiment, a slight bend 54 is defined at a central portion of the second lever arm 16 in a direction parallel to the plane of rotation of the first and second lever arms 14, 16 between the first and second positions. Thus, upon rotation of the foot pad 18 to a position generally parallel to the second lever arm first end 48, the second lever arm first end 48 is slightly offset from the foot pad 18 opposite the user contact surface 52. It will be recognized that, in this embodiment, the bend 54 may assist, in certain applications, in increasing the prominence of the user contact surface 52, thereby allowing for greater ease of establishment of contact between the user's foot and the user contact surface 52. However, it will also be recognized by one of skill in the art that inclusion of the bend 54 is not necessary to accomplish the present general inventive concept.

As discussed above, according to several features of the present general inventive concept, an adjustable coupling 20 is provided between the first and second lever arms 14, 16 such that the angle of extension of the second lever arm 16 in relation to the first lever arm 14 is adjustable. In the illustrated embodiment, the second end 38 of the first lever arm 14 defines a first through bore 56 which extends perpendicular to the plane of rotation of the first and second lever arms 14, 16 between the first and second positions. Likewise, the first end 48 of the second lever arm 16 defines a second through bore 58 which extends perpendicular to the plane of rotation of the first and second lever arms 14, 16 between the first and second positions. The first and second through bores 56, 58 are of substantially similar diameter, and both through bores 56, 58 define a plurality of parallel, longitudinally-extending ridges 60 disposed about the internal circumferential surfaces 62, 64 of the through bores 56, 58. In the illustrated embodiment, the ridges 60 are of substantially similar size and shape to one another, each ridge 60 is of a relatively small size, and the ridges 60 are closely spaced to one another about the internal circumferential surfaces 62, 64 of the through bores 56, 58. Thus, the second end 38 of the first lever arm 14 may be brought adjacent the first end 48 of the second lever arm 16 with the first and second through bores 56, 58 in substantially coaxial registration to one another. In this configuration, the second lever arm 16 may be rotated in relation to the first lever arm 14 to any of a plurality of incremental positions at which each ridge 60 of the second through bore 58 aligns with a corresponding ridge 60 of the first through bore 56, such that the first and second through bores 56, 58 are maintained in substantially coaxial registration to one another.

Figure 3:
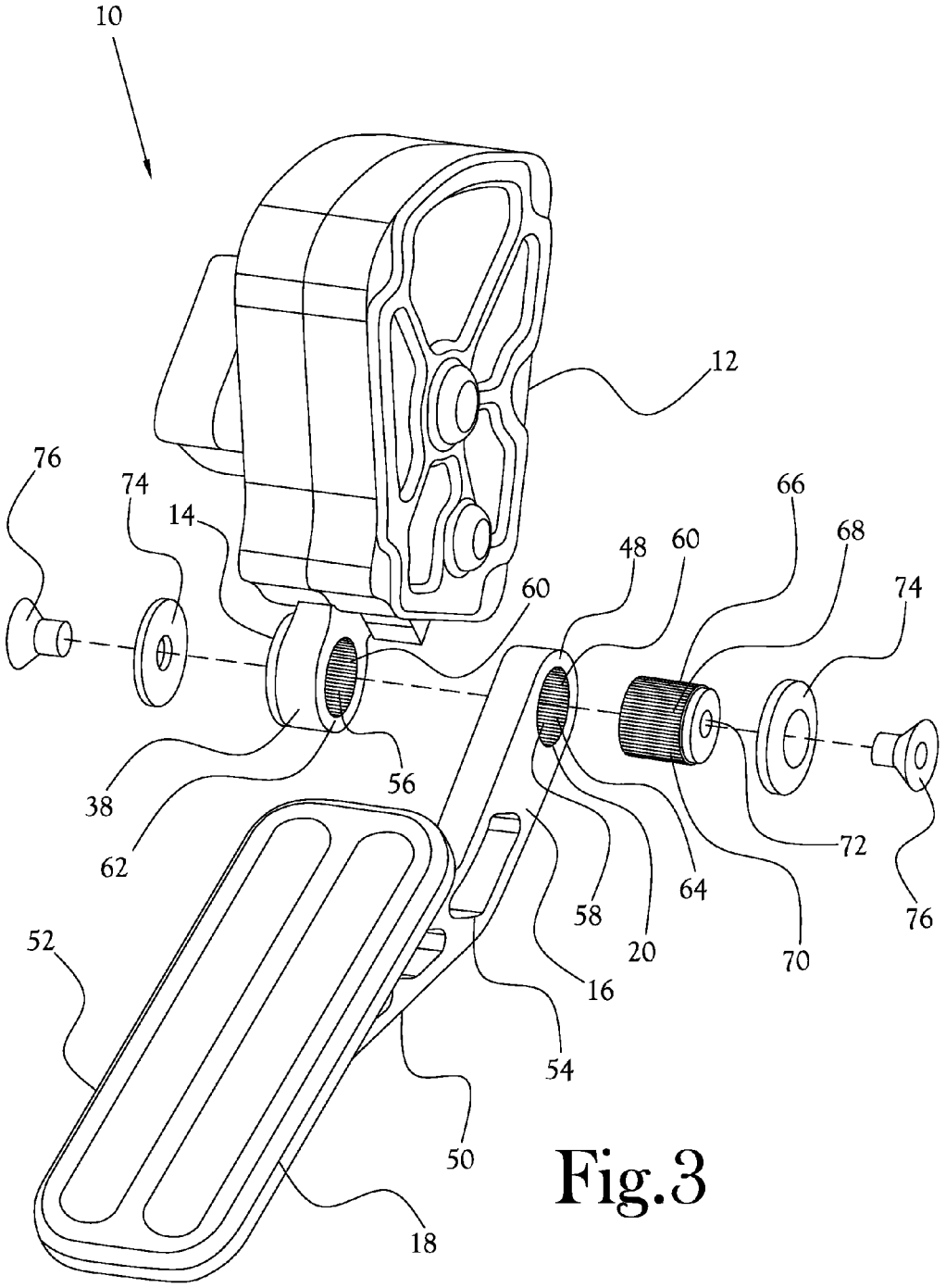
FIG. 3 is an exploded view of FIG. 2 showing one joining configuration of the first and second lever arms.

As shown in FIG. 3, a barrel 66 is provided having a generally cylindrical shape and defining a plurality of parallel, longitudinally-extending ridges 68 disposed about the external circumferential surface 70 of the barrel 66. The barrel 66 is sized, and the ridges 68 of the barrel 66 are sized, shaped, and spaced about the external circumferential surface 70 of the barrel 66, such that, when the first and second through bores 56, 58 are aligned in one of the above-discussed positions in substantially coaxial registration adjacent one another, the barrel 66 may be received within the first and second through bores 56, 58, and the ridges 68 of the barrel 66 may mate with the ridges 60 of the first and second through bores 56, 58, to lock the through bores 56, 58 in their registered position, thereby preventing rotation of the first and second lever arms 14, 16 in relation to one another about the coaxis of the barrel 66 and the first and second through bores 56, 58. In several embodiments, one or more fasteners are provided to secure the barrel 66 within the first and second through bores 56, 58, and to maintain the first through bore 56 adjacent the second through bore 58. For example, in the illustrated embodiment, the barrel 66 defines an internally-threaded bore 72 extending along a central axis thereof. A pair of washers 74 are provided which are positionable along the coaxis of the barrel 66 and the first and second through bores 56, 58, on opposite sides of the first and second lever arms 14, 16, and which extend annularly outwardly from the bore 72 beyond the first and second through bores 56, 58. A pair of externally-threaded fasteners 76 are threadably receivable within the internally-threaded bore 72 to secure the washers 74 on opposite sides of the first and second lever arms 14, 16, thereby securing the barrel 66 against slidable movement out of the first or second through bores 56, 58 along the coaxis of the barrel 66 and the first and second through bores 56, 58.

In light of the above, it will be recognized that the angle of extension of the second lever arm 16 in relation to the first lever arm 14 of the pedal 10 may be adjusted among a large number of incremental positions, as defined by the number and various locations of the ridges 60 of the first and second through bores 56, 58. Specifically, with reference to FIG. 3, upon placement of the second lever arm 16 adjacent the first lever arm 14 with the first and second through bores 56, 58 aligned in coaxial registration adjacent one another, the second lever arm 16 may be rotated in relation to the first lever arm 14 to position the second lever arm 16 at a desired one of the plurality of incremental positions at which each ridge 60 of the second through bore 58 aligns with a corresponding ridge 60 of the first through bore 56. The barrel 66 may then be inserted into both through bores 56, 58, thereby fixing the first and second lever arms 14, 16 against rotation or translation along the length dimensions of the first or second lever arms 14, 16. The washers 74 may be positioned on opposite sides of the barrel 66 and secured along an axial dimension of the barrel 66, thereby preventing withdrawal of the barrel 66 from the through bores 56, 58 and preventing separation of the first and second lever arms 14, 16 from one another.

In one application of the pedal 10, the angle of extension of the second lever arm 16 in relation to the first lever arm 14 of the pedal 10 may be adjusted by removing at least one of the washers 74 from the barrel 66, and withdrawing the barrel 66 from at least one of the first and second through bores 56, 58. Thereafter, the second lever arm 16 may be rotated in relation to the first lever arm 14 to position the second lever arm 16 at another one of the plurality of incremental positions at which each ridge 60 of the second through bore 58 aligns with a corresponding ridge 60 of the first through bore 56, whereupon the barrel 66 may be repositioned within the first and second through bores 56, 58 and the washers 74 may be reattached to secure the second lever arm 16 at the new position in relation to the first lever arm 14.

It will be recognized that the above-discussed configuration of the through bores 56, 58 and barrel 66 provides several unique advantages over other types of adjustable fasteners known in the art. For example, it will be recognized that, in order to allow rotation of the second lever arm 16 in relation to the first lever arm 14, the barrel 66 must be removed entirely from at least one of the first and second through bores 56, 58. Accordingly, in the event one or more of the externally-threaded fasteners 76 becomes loose, thereby allowing slight axial movement of the barrel 66 absent complete withdrawal of the barrel 66 from one of the first and second through bores 56, 58, the barrel 66 may still maintain the first and second lever arms 14, 16 in a relatively secure relationship to one another, such that the second lever arm 16 may be limited from rotating in relation to the first arm 14. Thus, the above-discussed connection provides a more secure connection of the first and second lever arms 14, 16 as compared to certain prior art devices.

While the present invention has been illustrated by description of several embodiments and while the illustrative embodiments have been described in detail, it is not the intention of the applicant to restrict or in any way limit the scope of the appended claims to such detail. Additional modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

Having thus described the aforementioned invention, what is claimed is:

1. An adjustable vehicle control pedal comprising:

a first lever arm having a first end rotatable along a plane between a first and second position, said first lever arm being biased toward said first position, said first lever arm first end defining a first through opening extending nonparallel to said plane, said first lever arm having a second end opposite said first lever arm first end, said first lever arm second end being received within a housing, said housing containing a pair of substantially coaxial compression springs in operable engagement with said first lever arm second end to bias said first lever arm toward said first position;

a second lever arm defining a long dimension and having a first end defining a second through opening extending nonparallel to said long dimension, said second lever arm being repositionable in relation to said first lever arm among a plurality of positions in which said first and second through openings are in substantially coaxial adjacent registration with one another;

an insert receivable through said first and second through openings in each of said plurality of positions to lock said second lever arm against rotation in relation to said first lever arm along said plane; and a position sensor in communication with said first lever arm and responsive to movement of said first lever arm between said first and second positions.

2. An adjustable vehicle control pedal comprising:

a first lever arm having a first end rotatable along a plane between a first and second position, said first lever arm being biased toward said first position, said first lever arm first end defining a first through opening extending nonparallel to said plane, said first lever arm having a second end opposite said first lever arm first end, said first lever arm second end being received within a housing;

a second lever arm defining a long dimension and having a first end defining a second through opening extending nonparallel to said long dimension, said second lever arm being repositionable in relation to said first lever arm among a plurality of positions in which said first and second through openings are in substantially coaxial adjacent registration with one another;

an insert receivable through said first and second through openings in each of said plurality of positions to lock said second lever arm against rotation in relation to said first lever arm along said plane; and a position sensor in communication with said first lever arm and responsive to movement of said first lever arm between said first and second positions, said position sensor comprising a gear disposed within said housing and linked to an electronic variable control, said gear being in mechanical engagement with a rack defined along said first lever arm, whereby rotation of said first lever arm between said first and second positions results in rotation of said gear.

3. An adjustable vehicle control pedal comprising:

a first lever arm having a first end rotatable along a plane between a first and second position, said first lever arm first end defining a first through opening extending substantially perpendicular to said plane and defining a substantially cylindrical shape, said first through opening defining a first plurality of parallel ridges extending axially about an internal surface thereof;

a second lever arm defining a long dimension and having a first end defining a second through opening extending nonparallel to said long dimension, said second lever arm being repositionable in relation to said first lever arm among a plurality of positions in which said first and second through openings are in substantially coaxial adjacent registration with one another;

an insert receivable through said first and second through openings in each of said plurality of positions to lock said second lever arm against rotation in relation to said first lever arm along said plane; and a position sensor in communication with said first lever arm and responsive to movement of said first lever arm between said first and second positions.

4. The adjustable vehicle control pedal of claim 3, said second through opening defining a substantially cylindrical shape having a diameter substantially equal to a diameter of said first through opening, said second through opening having a second plurality of parallel ridges extending axially about an internal surface thereof, wherein in each of said plurality of positions, each ridge of said second through opening aligns with one of said ridges of said first through opening.

5. The adjustable vehicle control pedal of claim 4, said insert defining a substantially cylindrical barrel having an external surface shaped to mate with and conform to said first and second pluralities of ridges along said through bores.

6. The adjustable vehicle control pedal of claim 5, said first plurality of ridges being spaced evenly about a circumference of said first through opening, and said second plurality of ridges being spaced evenly about a circumference of said second through opening.

7. The adjustable vehicle control pedal of claim 6 further including a pair of annular washers, said washers being securable at opposite axial ends of said barrel and extending annularly outwardly from a coaxis of said barrel and said through bores beyond said through bores.

8. The adjustable vehicle control pedal of claim 7 further including a pair of externally-threaded fasteners, each threaded fastener being receivable through a central hole defined by one of said washers and further receivable within an internally-threaded bore defined along a central axis of said barrel to fasten said one washer to said barrel.

9. The adjustable vehicle control pedal of claim 8, said second through opening extending substantially perpendicular to said long dimension.

10. The adjustable vehicle control pedal of claim 9, said second lever arm having a second end opposite said first end, said second lever arm second end having a foot pad linked thereto, said foot pad defining a user contact surface facing generally outwardly from said second lever arm.

11. The adjustable vehicle control pedal of claim 10, said foot pad being rotatable about said second lever arm along said plane.

12. The adjustable vehicle control pedal of claim 11, said second lever arm defining a bend along said plane at a central portion of said second lever arm.

* * * * *